US006319647B1

(12) United States Patent
Gutman et al.

(10) Patent No.: US 6,319,647 B1
(45) Date of Patent: Nov. 20, 2001

(54) TONER AND DEVELOPER FOR MAGNETIC BRUSH DEVELOPMENT SYSTEM

(75) Inventors: Edward J. Gutman, Webster; Barbara M. Ferguson, Keuka Park, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/520,360

(22) Filed: Mar. 7, 2000

(51) Int. Cl.[7] ..... G03G 9/087; G03G 9/113; G03G 15/09

(52) U.S. Cl. ..... 430/111.41; 430/108.24; 430/108.3; 430/109.4; 430/111.4; 399/267

(58) Field of Search ..... 430/106, 106.6, 430/108, 109, 110, 111, 108.24, 108.3, 108.4, 108.6, 108.7, 109.4, 111.32, 111.4, 111.41; 399/267

(56) References Cited

U.S. PATENT DOCUMENTS

| | | | | |
|---|---|---|---|---|
| 3,590,000 | | 6/1971 | Palermiti et al. . | |
| 3,981,272 | | 9/1976 | Smith et al. | 118/637 |
| 4,155,329 | | 5/1979 | Tsukamoto et al. | 118/658 |
| 4,298,672 | | 11/1981 | Lu | 430/108 |
| 4,338,390 | | 7/1982 | Lu | 430/106 |
| 4,375,673 | | 3/1983 | Lewis et al. . | |
| 4,465,730 | | 8/1984 | Okada | 428/246 |
| 4,558,108 | | 12/1985 | Alexandru et al. | 526/310 |
| 4,935,326 | | 6/1990 | Creatura et al. | 430/108 |
| 4,937,166 | | 6/1990 | Creatura et al. | 430/108 |
| 5,196,803 | | 3/1993 | Cellini, Jr. et al. | 324/713 |
| 5,227,460 | | 7/1993 | Mahabadi et al. | 528/272 |
| 5,236,629 | | 8/1993 | Mahabadi et al. | 430/137 |
| 5,345,298 | | 9/1994 | Corrigan, Jr. . | |
| 5,376,494 | * | 12/1994 | Mahabadi et al. | 430/109 |
| 5,416,566 | | 5/1995 | Edmunds et al. | 118/657 |
| 5,506,083 | * | 4/1996 | Nash et al. | 430/106 |
| 5,532,097 | | 7/1996 | Tavernier et al. . | |
| 5,543,259 | * | 8/1996 | Schwarz et al. | 430/106 |
| 5,545,501 | | 8/1996 | Tavernier et al. | 430/106.6 |
| 5,663,025 | * | 9/1997 | Ciccarelli et al. | 430/106 |
| 5,719,002 | * | 2/1998 | Ciccarelli et al. | 430/137 |
| 5,912,099 | * | 6/1999 | Kanbayashi et al. | 430/106 |
| 6,143,457 | * | 7/2000 | Carlini et al. | 430/109.4 |

FOREIGN PATENT DOCUMENTS

| | | |
|---|---|---|
| 0 801 333 A | 10/1997 | (EP) . |
| 0 980 030 A | 2/2000 | (EP) . |

OTHER PUBLICATIONS

R. J. Nash, and J. T. Bickmore, "Toner Impaction and Triboelectric Aging", 4$^{th}$ International Congress on Advances in Non–Impact Printing Technology, R. J. Nash, ed., IS&T, Springfield, VA, pp. 113–126 (1988).

E.J. Gutman and G. C. Hartmann, Journal of Imaging Science and Technology, vol. 36, No. 4, Jul./Aug. 1992, pp. 335–349.

* cited by examiner

*Primary Examiner*—Janis L. Dote
(74) *Attorney, Agent, or Firm*—Oliff & Berridge, PLC; Eugene O. Palazzo

(57) ABSTRACT

A toner of toner particles containing at least one binder, at least one colorant, and preferably one or more external additives is advantageously formed into a developer and used in a magnetic brush development system to achieve consistent, high quality copy images. The toner particles, following triboelectric contact with carrier particles, exhibit a charge per particle diameter (Q/D) of from 0.6 to 0.9 fC/$\mu$m and a triboelectric charge of from 20 to 25 $\mu$C/g. The toner particles preferably have an average particle diameter of from 7.8 to 8.3 microns. The toner is combined with carrier particles to achieve a developer, the carrier particles preferably having an average diameter of from 45 to 55 microns and including a core of ferrite substantially free of copper and zinc coated with a coating comprising a polyvinylidenefluoride polymer or copolymer and a polymethyl methacrylate polymer or copolymer.

18 Claims, 5 Drawing Sheets

SAD - X Tower

SAD - Y Tower $A_t$ - X Tower $A_t$ - Y Tower $A_t$ - Y Tower
DC70 Aruba DVT-II
Yellow
Cyan
Magenta
Black
At
CopyCount
600
500
400
300
200
100
0
0
10
20
30
40
50
60
70
80
90
100
110
120
130
140
150
160
170
180
190
200

TONER AND DEVELOPER FOR MAGNETIC BRUSH DEVELOPMENT SYSTEM

BACKGROUND OF THE INVENTION

1. Field of Invention

This invention relates to toners, developers containing the toners, and a method of forming images with the developers utilizing a magnetic brush development system. More in particular, the invention relates to toners and developers having carefully controlled properties to provide superior print quality when used in developing electrostatic images with a magnetic brush development system.

2. Description of Related Art

U.S. Pat. No. 5,545,501 describes an electrostatographic developer composition comprising carrier particles and toner particles with a toner particle size distribution having a volume average particle size (T) such that 4 $\mu$m≦T≦12 $\mu$m and an average charge (absolute value) pro diameter in femtocoulomb/10 $\mu$m ($C_T$) after triboelectric contact with said carrier particles such that 1 fC/10 $\mu$m≦$C_T$≦10 fC/10 $\mu$m characterized in that (i) said carrier particles have a saturation magnetization value, $M_{sat}$, expressed in Tesla (T) such that $M_{sat}$≧0.30 T, (ii) said carrier particles have a volume average particle size ($C_{avg}$) such that 30 $\mu$m≦$C_{avg}$≦60 $\mu$m, (iii) said volume based particle size distribution of said carrier particles has at least 90% of the particles having a particle diameter C such that 0.5 $C_{avg}$≦C≦2 $C_{avg}$, (iv) said volume based particles size distribution of said carrier particles comprises less than b % particles smaller than 25 $\mu$m wherein b=0.35×$(M_{sat})^2$×P with $M_{sat}$: saturation magnetization value, $M_{sat}$, expressed in T and P: the maximal field strength of the magnetic developing pole expressed in kA/m, and (v) said carrier particles comprise a core particle coated with a resin coating in an amount (RC) such that 0.2% w/w≦RC≦2% w/w. See the Abstract. This patent describes that such developer achieves images of offset-quality in systems in which a latent image is developed with a fine hair magnetic brush. See column 4, lines 7–17 in said patent.

XEIKON NV currently supplies the market with developers from AGFA for magnetic brush development systems. These developers are comprised of toner and carrier particles. The toner is believed to be comprised of pigments and two polyesters, a propoxylated bisphenol-A, hexanedioic acid, isophthalic acid polyester and an ethoxylated bisphenol-A ethylene glycol, isophthalic acid, terephthalic acid polyester, while the carrier is believed to be comprised of an iron-zinc-copper oxide core coated with a crosslinked siloxane. However, such developers suffer from lower triboelectric stability and image quality stability, and insufficient color gamut.

What is still desired is a set of developers comprised of toners and carriers that possess a combination of properties such that when used to develop a latent image on the surface of a photoreceptor with a magnetic brush, the color image produced in this xerographic manner exhibits a very high quality, improved in most properties over conventional magnetic brush toners and developers.

SUMMARY OF THE INVENTION

It is an object of the present invention to provide a set of color toners and developers each having a set of properties such that the developers containing such toners along with carrier particles can achieve images having high quality when formed with a magnetic brush system. It is a further object of the invention to obtain toners and developers having superior triboelectric and image quality stability.

It is a still further object of the invention to develop suitable carriers for use in combination with the toners in order to obtain two component developers possessing the desired properties.

It is a still further object of the invention to form images utilizing a magnetic brush with the developers of the invention, which images have superior quality compared to conventional magnetic brush developers.

These and other objects are achieved in the present invention by a toner comprising toner particles comprised of at least one binder, at least one colorant, and optionally one or more additives, wherein following triboelectric contact with carrier particles, the toner has a charge per particle diameter (Q/D) of from 0.6 to 0.9 fC/$\mu$m and a triboelectric charge of from 20 to 25 $\mu$C/g, wherein the toner melt viscosity at 100° C. ranges from 35,000 to 70,000 poise, and wherein the toner particles have an average particle diameter of from 7.8 to 8.3 microns. These objects are also achieved by a toner comprising toner particles comprised of at least one binder comprising a propoxylated bisphenol A fumarate resin containing gel for cyan, magenta and black toners but not containing gel for yellow toner, at least one colorant comprising pigment selected from the group consisting of cyan, yellow, magenta and black, and at least one external additive comprising one or more of silicon dioxide powder, untreated titanium dioxide powder or zinc stearate powder.

A developer comprising the toner particles in combination with carrier particles such that the developer has an $A_T$ of from $300\times10^{-2}$ $\mu$C/g to $500\times10^{-2}$ $\mu$C/g also achieves the objects of the invention. Finally, the invention also relates to an electrostatographic image forming apparatus comprising a photoreceptor, a magnetic brush development system, and a housing in association with the magnetic brush development system and containing the foregoing developer.

DETAILED DESCRIPTION OF PREFERRED EMBODIMENTS

Figure 1:
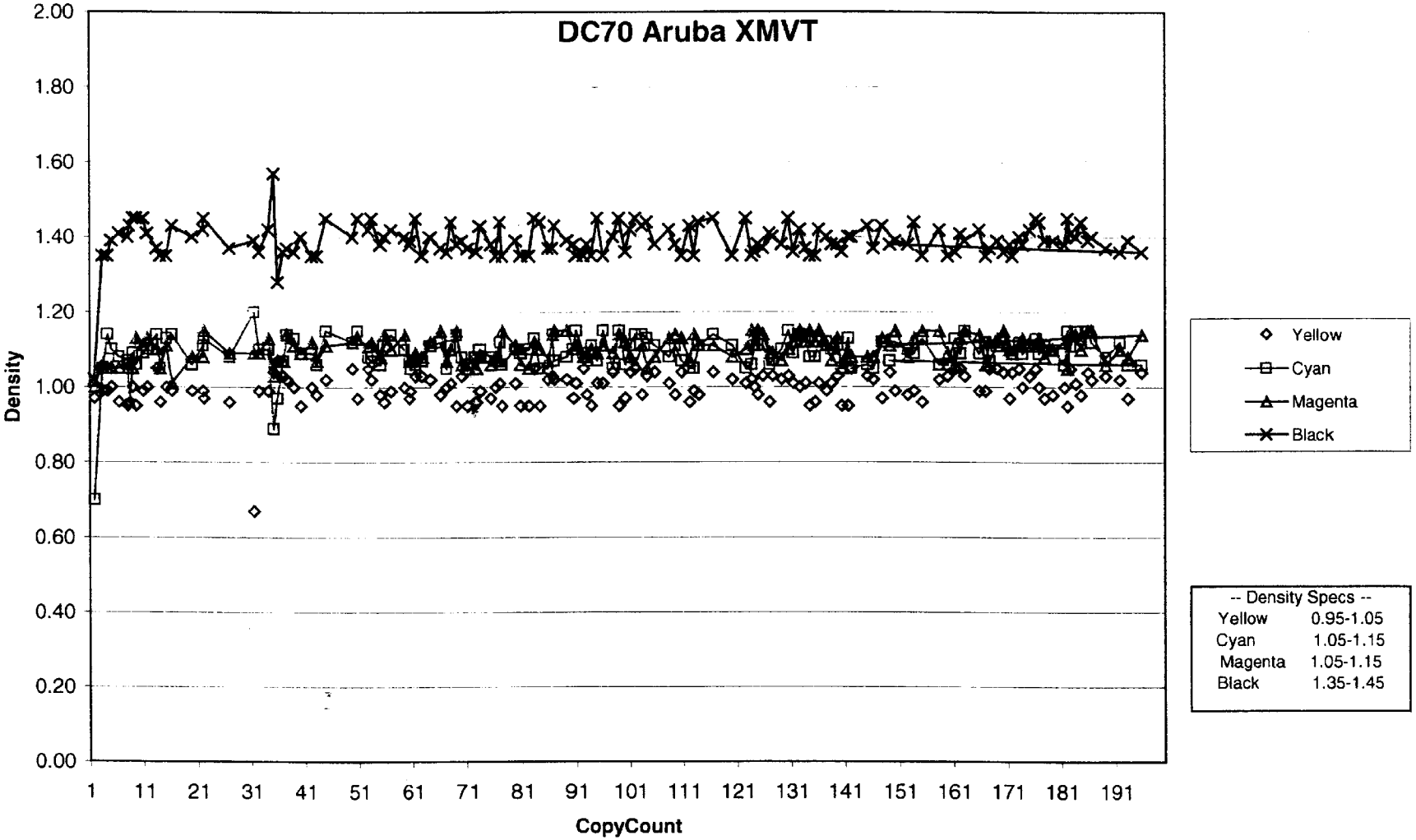
FIGS. 1 and 2 graphically summarize developer density over time for two different experiments with developers of the present invention.

Generally, the process of electrophotographic printing includes charging a photoconductive member to a substantially uniform potential to sensitize the surface thereof. The charged portion of the photoconductive surface is exposed to a light image from, for example, a scanning laser beam, an LED source, etc., or an original document being reproduced. This records an electrostatic latent image on the photoconductive surface of the photoreceptor. After the electrostatic latent image is recorded on the photoconductive surface, the latent image is developed.

In the present invention, two-component developer materials are used for development. A typical two-component developer comprises magnetic carrier granules having toner particles adhering triboelectrically thereto. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

A commonly known way of developing the latent image on the photoreceptor is by use of one or more magnetic brushes. See, for example, U.S. Pat. Nos. 5,416,566, 5,345,298, 4,465,730, 4,155,329 and 3,981,272, incorporated herein by reference. The toner of the developer may be formulated to carry either a negative or positive charge, and is in any case selected vis-a-vis the carrier so that the toner particles acquire the proper operating charge with respect to the latent electrostatic image being developed. Thus, when the developer is brought into operative contact with the photoconductive surface of the photoreceptor, the greater attractive force of the charged image causes the toner particles to leave the carrier particles and adhere to the image portion of the plate.

The aforesaid magnetic brush typically is comprised of a roll having a tube-like member or sleeve, which is rotatably supported. The sleeve is preferably made from a non-magnetic material. One or more magnets are mounted inside the sleeve. The roll is disposed so that a portion of the sleeve is immersed in or in contact with a supply of developer comprising the carrier particles and the toner particles.

As a result, the developer is magnetically attracted to the surface of the sleeve and arranges thereupon in the form of a brush. Thus, when the photoreceptor bearing the latent electrostatic image thereon is brought into physical contact with the brush, the attractive force of the electrostatic charge on the photoreceptor surface in the image areas, which is greater than the force holding the toner to the carrier particles, draws the toner from the magnetic brush roller and onto the image areas to render the image visible.

The electrophotographic marking process given above can be modified to produce color images. In such a process, each color of the image is successively developed and transferred to an image receiving substrate, for example paper, thus forming an image-wise configuration of the developed image upon the substrate.

This invention describes the aspects of novel toners and developers that operate in the restrictive magnetic brush development environment to achieve image qualities superior to prior art toners and developers, the developers possessing better triboelectric stability and image quality stability as well as exhibiting better gloss and a wider color gamut. Color gamut, the maximum set of colors that can be printed, is superior for such a four-color xerographic system. Solid and halftone areas are uniform and stable in density and color. They are of uniform gloss. Pictorials contain accurate, realistic rendition. Text is crisp with well-defined edges regardless of font size or type. There is no background. Color, solids, halftones, gloss, pictorials, text and background are stable over the entire job run. The prints do not exhibit objectionable paper curl, nor are the images disturbed by handling or storage, for example when stored in contact with vinyl surfaces.

By this invention, color toners and developers are achieved having the necessary properties to function in magnetic brush development systems. Four different color toners, cyan (C), magenta (M), yellow (Y) and black (K), are typically used in developing full color images (although other color toners may also be used). Each of these color toners in the present invention are preferably comprised of at least resin binder, appropriate colorants and an additive package comprised of one or more additives. Suitable and preferred materials for use in preparing toners of the invention will now be discussed.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Polyester resins are the most preferred binder resins in the invention.

Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl) alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference. Also, polyester resins obtained from the reaction of bisphenol A and propylene oxide, and in particular including such polyesters followed by the reaction of the resulting product with fumaric acid, and branched polyester resins resulting from the reaction of dimethylterephthalate with 1,3-butanediol, 1,2-propanediol, and pentaerythritol may also preferable be used. Further, low melting polyesters, especially those prepared by reactive extrusion, reference U.S. Pat. No. 5,227,460, the disclosure of which is totally incorporated herein by reference, can be selected as toner resins. Other specific toner resins may include styrene-methacrylate copolymers, styrenebutadiene copolymers, PLIOLITES™, and suspension polymerized styrenebutadienes (U.S. Pat. No. 4,558,108, the disclosure of which is totally incorporated herein by reference).

The most preferred resin binders for use in the present invention comprise polyester resins containing both linear portions and cross-linked portions of the type described in U.S. Pat. No. 5,227,460 (incorporated herein by reference above).

The cross-linked portion of the binder consists essentially of microgel particles with an average volume particle diameter up to 0.1 micron, preferably about 0.005 to about 0.1 micron, as determined by scanning electron microscopy and transmission electron microscopy, the microgel particles being substantially uniformly distributed throughout the linear portions. This resin may be prepared by a reactive melt mixing process as known in the art. The highly cross-linked dense microgel particles distributed throughout the linear portion impart elasticity to the resin, which improves the resin offset properties, while not substantially affecting the resin minimum fix temperature.

The toner resin is thus preferably a partially cross-linked unsaturated resin such as unsaturated polyester prepared by cross-linking a linear unsaturated resin (hereinafter called base resin) such as linear unsaturated polyester resin, preferably with a chemical initiator, in a melt mixing device such as, for example, an extruder at high temperature (e.g., above the melting temperature of the resin and preferably up to about 150° C. above that melting temperature) and under high shear.

The toner resin has a weight fraction of the microgel (gel content) in the resin mixture in the range typically from about 0 to about 50 weight percent, preferably from about 1 to about 20 weight percent, more preferably about 9 to about 18 weight percent, more preferably about 10 to 15 weight percent, and most preferably about 13 to 15 weight percent. In a most preferred embodiment of the present invention, the resin for magenta, black and cyan toners has a gel content of, for example, 10 to 15% by weight of the toner resin, while the resin for yellow toner preferably contains no gel. The linear portion is comprised of base resin, preferably unsaturated polyester, in the range from about 50 to about 100 percent by weight of said toner resin, and preferably in the range from about 70 to about 98 percent by weight of said toner resin. The linear portion of the resin preferably comprises low molecular weight reactive base resin that did not cross-link during the cross-linking reaction, preferably unsaturated polyester resin.

The molecular weight distribution of the resin is thus bimodal, having different ranges for the linear and the cross-linked portions of the binder. The number-average molecular weight (Mn) of the linear portion as measured by gel permeation chromatography (GPC) is in the range of from, for example, about 1,000 to about 20,000, and preferably from about 3,000 to about 8,000. The weight-average molecular weight (Mw) of the linear portion is in the range of from, for example, about 4,000 to about 40,000, and preferably from about 5,000 to about 20,000. The weight average molecular weight of the gel portions is, on the other hand, generally greater than 1,000,000. The molecular weight distribution (Mw/Mn) of the linear portion is in the range of from, for example, about 1.5 to about 6, and preferably from about 1.8 to about 4. The onset glass transition temperature (Tg) of the linear portion as measured by differential scanning calorimetry (DSC) is in the range of from, for example, about 50° C. to about 70° C.

This binder resin can provide a low melt toner with a minimum fix temperature of from about 100° C. to about 200° C., preferably about 100° C. to about 160° C., more preferably about 110° C. to about 140° C., provide the low melt toner with a wide fusing latitude to match paper gloss and minimize or prevent offset of the toner onto the rolls in the gloss enhancing module (GEM unit), and maintain high toner pulverization efficiencies. The toner resins and thus toners show minimized or substantially no vinyl offset.

In a preferred embodiment, the cross-linked portion consists essentially of very high molecular weight microgel particles with high density cross-linking (as measured by gel content) and which are not soluble in substantially any solvents such as, for example, tetrahydrofuran, toluene and the like. The microgel particles are highly cross-linked polymers with a very small, if any, cross-link distance. This type of cross-linked polymer may be formed by reacting chemical initiator with linear unsaturated polymer, and more preferably linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly cross-linked microgel. This renders the microgel very dense and results in the microgel not swelling very well in solvent. The dense microgel also imparts elasticity to the resin and increases its hot offset temperature while not affecting its minimum fix temperature.

Linear unsaturated polyesters used as the base resin are low molecular weight condensation polymers which may be formed by the step-wise reactions between both saturated and unsaturated diacids (or anhydrides) and dihydric alcohols (glycols or diols). The resulting unsaturated polyesters are reactive (e.g., cross-linkable) on two fronts: (i) unsaturation sites (double bonds) along the polyester chain, and (ii) functional groups such as carboxyl, hydroxy, etc., groups amenable to acid-base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as for example maleic acid, fumaric acid, chloromaleic acid, methacrylic acid, acrylic acid, itaconic acid, citraconic acid, mesaconic acid, maleic anhydride, and the like and mixtures thereof. Suitable diols include but are not limited to for example propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like and mixtures thereof, soluble in good solvents such as, for example, tetrahydrofuran, toluene and the like.

Preferred unsaturated polyester base resins are prepared from diacids and/or anhydrides such as, for example, maleic anhydride, fumaric acid, and the like and mixtures thereof, and diols such as, for example, propoxylated bisphenol A, propylene glycol, and the like and mixtures thereof. A most preferred polyester is poly(propoxylated bisphenol A fumarate).

In a most preferred embodiment of the present invention, the toner binder resin comprises either (i) a melt extrusion mixture of (a) linear propoxylated bisphenol A fumarate resin and (b) this resin cross-linked by reactive extrusion of this linear resin, with a gel content of from about 27 to about 37 weight percent, to produce a resin with a gel content of 9 to 18 weight percent; or (ii) a reactive extrusion of linear propoxylated bisphenol A fumarate resin to produce a gel content of 9 to 18 weight percent. Linear propoxylated bisphenol A fumarate resin is commercially available under the tradename SPAR from Reichhold Chemicals, Inc., RESAPOL HT from Resana S. A., or as a proprietary resins called XP767 and XP777 from Resana S. A. or RUCO Polymers/A Sybron Chemicals Company, for example. For suitable toner storage and prevention of vinyl offset, the polyester resin blend preferably has a glass transition temperature (Tg) of from, for example, 50 to 65° C.

Chemical initiators such as, for example, organic peroxides or azo-compounds are preferred for making the cross-linked toner resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di (2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl 2,5-di(t-butyl peroxy)hexane, t-butyl cumyl peroxide, bis(t-butyl peroxy)diisopropyl benzene, di-t-butyl peroxide and 2,5-dimethyl 2,5-di (t-butyl peroxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy) valerate, 1,1-di(t-butyl peroxy) 3,3,5-trimethyl cyclohexane, 1,1-di(t-butyl peroxy) cyclohexane, 1,1-di(t-amyl peroxy)cyclohexane, 2,2-di(t-butyl peroxy)butane, ethyl 3,3-di(t-butyl peroxy)butyrate and ethyl 3,3-di(t-amyl peroxy)butyrate. Suitable azo-compounds include azobis-isobutyronitrile, 2,2'-azobis (isobutyronitrile), 2,2'-azobis(2,4-dimethyl valeronitrile), 2,2'-azobis (methyl butyronitrile), 1,1'-azobis(cyano cyclohexane) and other similar known compounds.

By permitting use of low concentrations of chemical initiator and utilizing all of it in the cross-linking reaction, usually in the range from about 0.01 to about 10 weight percent, and preferably in the range from about 0.1 to about 4 weight percent, the residual contaminants produced in the cross-linking reaction in preferred embodiments can be minimal. Since the cross-linking can be carried out at high temperature, the reaction is very fast (e.g., less than 10 minutes, preferably about 2 seconds to about 5 minutes residence time) and thus little or no unreacted initiator remains in the product.

The low melt toners and toner resins may be prepared by a reactive melt mixing process wherein reactive resins are partially cross-linked. For example, low melt toner resins may be fabricated by a reactive melt mixing process comprising the steps of: (1) melting reactive base resin, thereby forming a polymer melt, in a melt mixing device; (2) initiating cross-linking of the polymer melt, preferably with a chemical cross-linking initiator and increased reaction temperature; (3) keeping the polymer melt in the melt mixing device for a sufficient residence time that partial cross-linking of the base resin may be achieved; (4) providing sufficiently high shear during the cross-linking reaction to keep the gel particles formed during cross-linking small in size and well distributed in the polymer melt; (5) optionally devolatilizing the polymer melt to remove any effluent volatiles; and (6) optionally adding additional linear base resin after the cross-linking in order to achieve the desired level of gel content in the end resin. The high temperature reactive melt mixing process allows for very fast cross-linking which enables the production of substantially only microgel particles, and the high shear of the process prevents undue growth of the microgels and enables the microgel particles to be uniformly distributed in the resin.

A reactive melt mixing process is a process wherein chemical reactions can be carried out on the polymer in the melt phase in a melt mixing device, such as an extruder. In preparing the toner resins, these reactions are used to modify the chemical structure and the molecular weight, and thus the melt rheology and fusing properties, of the polymer. Reactive melt mixing is particularly efficient for highly viscous materials, and is advantageous because it requires no solvents, and thus is easily environmentally controlled. As soon as the amount of cross-linking desired is achieved, the reaction products can be quickly removed from the reaction chamber.

The resins are generally present in the toner of the invention in an amount of from about 40 to about 98 percent by weight, and more preferably from about 70 to about 98 percent by weight, although they may be present in greater or lesser amounts, provided that the objectives of the invention are achieved.

The toner resins can be subsequently melt blended or otherwise mixed with a colorant, charge carrier additives, surfactants, emulsifiers, pigment dispersants, flow additives, and the like. The resultant product can then be pulverized by known methods such as milling to form toner particles. If desired, waxes with a molecular weight of from about 1,000 to about 7,000, such as polyethylene, polypropylene, and paraffin waxes, can be included in, or on the toner compositions as fusing release agents.

Various suitable colorants of any color without restriction can be employed in toners of the invention, including suitable colored pigments, dyes, and mixtures thereof including Carbon Black, such as REGAL 330 carbon black (Cabot), Acetylene Black, Lamp Black, Aniline Black, Diarylide Yellow, SUNFAST YELLOW, POLYTONE YELLOW, Arylide Yellow, Chrome Yellow, Zinc Yellow, SICOFAST YELLOW, SUNBRITE YELLOW, LUNA YELLOW, NOVAPERM YELLOW, Chrome Orange, BAYPLAST ORANGE, Cadmium Red, LITHOL SCARLET, Rubines, Quanacridones, RHODAMINE LAKE C, SUNTONE MAGENTA, POLYTONE MAGENTA, HOSTAPERM RED, FANAL PINK, HOSTAPERM PINK, LITHOL RED, RHODAMINE LAKE B, Brilliant Carmine, SUNTONE CYAN, POLYTONE CYAN, HELIOGEN BLUE, HOSTAPERM BLUE, NEOPAN BLUE, PV FAST BLUE, Phthalocyanine Blue, CINQUASSI GREEN, HOSTAPERM GREEN, titanium dioxide, cobalt, nickel, iron powder, SICOPUR 4068 FF, and iron oxides such as MAPICO BLACK (Laporte Pigments, Inc.), NP608 and NP604 (Northern Pigment), BAYFERROX 8610 (Bayer), MO8699 (Mobay), TMB-100 (Magnox), mixtures thereof and the like.

The colorant, preferably black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 10 percent by weight. In a most preferred embodiment, the yellow, cyan and magenta pigments are provided as pigments predispersed in an additional amount of linear polyester resin. This facilitates mixing of the pigments into the toner binder.

Any suitable surface additives may be used in the present invention. Most preferred in the present invention are one or more of $SiO_2$ (or silica or silicon dioxide), $TiO_2$ (or titania or titanium dioxide) and ZnSt (or zinc stearate) as external surface additives. In general, silica is applied to the toner surface for toner flow, triboelectric enhancement, admix control, improved development and transfer stability and higher toner blocking temperature. $TiO_2$ is applied for improved relative humidity (RH) stability, triboelectric control and improved development and transfer stability.

The $SiO_2$ and $TiO_2$ should preferably have a primary particle size of less than 20 nm. The silica preferably has a primary particle size in the range 6 to 10 nm. The titania preferably has a primary particle size in the range 13 to 17 nm. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 130 to 200% surface area coverage (SAC). Another metric relating to the amount and size of the additives is "SAC×Size" ((surface area coverage) times (the primary particle size of the additive in nanometers)), for which the additives should preferably have a total SAC×Size range between, for example, 1,300 to 2,300.

Most preferably, the $SiO_2$ added is surface treated with HMDS (hexamethyldisilazane). The treated fumed Silica is commercially available as TS530 from Cabot Corporation, Cab-O-Sil Division. The titania is most preferably an untreated titania. The titanium dioxide is available as P-25 from Nippon Aerosil Co., Ltd.

Zinc stearate is preferably also used as an external additive for the toners of the invention, the zinc stearate providing lubricating properties. Zinc stearate provides developer conductivity and triboelectric enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate having a particle size which passes through a 325 screen and is known as Zinc Stearate L made by Ferro Corporation, Polymer Additives Division.

Most preferably, the toners contain from, for example, about 0.5 to 5.0 weight percent titania, about 0.1 to 3.0 weight percent HMDS treated silica and about 0.1 to 2.0 weight percent zinc stearate.

The additives discussed above are chosen to enable superior toner flow properties, as well as high toner charge and charge stability.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88, and the like. These additives may be incorporated into the toner in an amount of from about 0.1 percent by weight to about 20 percent by weight, and preferably from 1 to about 3 percent by weight.

The following Table 1 describes the most preferred toners for use in the present invention. In Table 1, all percentages are by weight of the toner. Y refers to yellow, C to cyan, M to magenta and K to black.

TABLE 1

| | Toner | | | | | |
|---|---|---|---|---|---|---|
| Color | % Resin | % Gel in Resin | % Pigment (Solid Basis) | % Titania | % HMDS Treated Silica | % Zinc Stearate |
| Y | 89.2 | 0 | 7.8 | 2.1 | 0.6 | 0.3 |
| C | 94.4 | 10 | 3.2 | 1.5 | 0.6 | 0.3 |
| M | 93.7 | 14 | 3.4 | 2.0 | 0.6 | 0.3 |
| K | 92.7 | 14 | 4.9 | 1.5 | 0.6 | 0.3 |

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion.

The toner is preferably made by first mixing the binder, preferably comprised of both the linear resin and the cross-linked resin as discussed above, and the colorant together in a mixing device, preferably an extruder, and then extruding the mixture. The extruded mixture is then preferably micronized in a grinder along with about 0.3 to about 0.5 weight percent of the total amount of silica to be used as an external additive. The toner is then classified to form a toner with the desired volume median particle size and percent fines as discussed above. Care should also be taken in the method in order to limit the coarse particles, grits and giant particles. Subsequent toner blending of the remaining external additives is preferably accomplished using a mixer or blender, for example a Henschel mixer, followed by screening to obtain the final toner product.

In a preferred embodiment of the invention, the finished toner particles have an average particle size (diameter) of from about 7.8 to 8.3 microns, most preferably of from about 7.9 to 8.2 microns, as measured by the well known Coulter counter technique. Most preferably, no more than 8% have a size less than 5 microns measured by number and no more than 1% have a size greater than 16 microns measured by volume.

In order to provide toners which meet the gloss requirements for the fused image and do not hot offset to the rolls of the gloss enhancing module (GEM unit) in the device, the toners preferably have a melt viscosity at 100° C. of, for example, 35,000 to 70,000 poise; at 125° C. of, for example, 2,300 to 7,000 poise; and, at 150° C. of, for example, 800 to 2,000 poise. The melt viscosities were measured with a rheometer (model RMS-800, made by Rheometrics, Inc.) at 40 radians per second. This narrow range of melt viscosity profile will provide the required minimum fix, appropriate gloss and the desired hot offset behavior, enabling long roll life in the magnetic brush development system.

The charge of a toner is described in terms of the charge/particle diameter, Q/D, in fC/$\mu$m following triboelectric contact of the toner with carrier particles. The charge per particle diameter (Q/D) of the toner particles has an average value of from, for example, 0.3 to 1.1, preferably from 0.6 to 0.9 fC/$\mu$m. This charge must remain stable throughout the development process in order to insure consistency in the richness of the images obtained using the toner.

The measurement of the average Q/D of the toner particles can be done by means of a charge spectrograph apparatus as well known in the art. See, for example, U.S. Pat. No. 4,375,673, incorporated herein by reference. The spectrograph is used to measure the distribution of the toner particle charge (Q in fC) with respect to a measured toner diameter (D in $\mu$m). The measurement result is expressed as percentage particle frequency (in ordinate) of same Q/D ratio on Q/D ratio expressed as fC/$\mu$m (in abscissa).

Each of the resulting colors of toner particles can then be formulated into developer compositions. Preferably, the toner particles are mixed with carrier particles to achieve a two-component developer composition.

Suitable and preferred materials for use as carriers used in preparing developers containing the above-discussed toners of the invention that possess the properties discussed above will now be discussed. The toner particles triboelectrically adhere to the surface of the carrier particles.

Illustrative examples of carrier particles that can be selected for mixing with the toner composition prepared in accordance with the present invention include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers are disclosed in U.S. Pat. Nos. 4,937,166 and 4,935,326, the disclosures of which are hereby totally incorporated herein by reference.

In a preferred embodiment, the carrier core is comprised of ferrite particles. Most preferably, the ferrite particles are substantially free of both zinc and copper. Such ferrite particles are described in co-pending U.S. patent application Ser. No. 09/444,701, filed Nov. 24, 1999, now issued U.S. Pat. No. 6,143,456 incorporated herein by reference in its entirety. As explained in the co-pending application, by "substantially free of" is meant that the ferrite particles contain less than 2,000 ppm copper and less than 4,000 ppm zinc on a weight basis of the ferrite particle, which values correspond approximately to less than 0.25 wt. % copper oxide and less than 0.50 wt. % zinc oxide on the basis of the overall ferrite particle weight. Preferably, the ferrite particles contain less than 1,000 ppm copper, more preferably less than 250 ppm copper, and most preferably less than 150 ppm copper, on a weight basis of the ferrite particle and less than 1,000 ppm zinc, more preferably less than 250 ppm zinc, and most preferably less than 100 ppm zinc, on a weight basis of the ferrite particle. The ferrite particles used as carrier cores in the present invention thus contain copper and zinc merely as impurities at most.

Most preferably, the ferrite particles are Mn—Mg—Sr ferrite particles. Such ferrite particles may be commercially obtained, for example, from Powdertech and are known as EF-A60, EF-B75, EF-B65, EF-B55, and EF-C30 or as a proprietary material known as PXC-150.

The ferrite particles to be used as cores in the invention preferably have an average particle size (diameter) of from, for example, 10 to 100 microns, preferably 30 to 80 microns, most preferably 45 to 55 microns, as determined by standard laser diffraction techniques. In addition, the ferrite core particles have a magnetic saturation of, for example, 30 to 110 emu/g, preferably 40 to 100 emu/g, more preferably 50 to 75 emu/g, most preferably 60 to 65 emu/g, a powder density as determined by ASTM Test B-212-89 of 2.0 to 3.0 g/cm$^3$, preferably 2.2 to 2.5 g/cm$^3$, most preferably about 2.40 g/cm$^3$, a conductivity of 2 to $10\times10^{-10}$ (ohm-cm)$^{-1}$, most preferably of about $6\times10^{-10}$ (ohm-cm)$^{-1}$ and a breakdown voltage of 700 to 1000 V, most preferably of about 850 V. The conductivity of the core is measured by applying a 200 Volt fixed voltage across a 0.1 inch magnetic brush in a static (non-rotating) mode. The resultant current flow through the material is used to calculate the conductivity of the core. The voltage breakdown of the core is measured by applying a fixed rate of increasing voltage across 0.1 inch magnetic brush while under rotation. The applied voltage at which 100 microamps of current flows through the sample is defined as the breakdown voltage. See, for example, U.S. Pat. No. 5,196,803, incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, mixtures thereof, other known coatings and the like.

In a most preferred embodiment of the invention, the ferrite particles are coated with a mixture of at least two dry polymer components, which dry polymer components are preferably not in close proximity thereto in the triboelectric series, and most preferably of opposite charging polarities with respect to the toner selected.

The electronegative polymer, i.e., the polymer that will generally impart a positive charge on the toner which it is contacted with, is preferably comprised of a polyvinylidenefluoride polymer or copolymer. Such polyvinylidenefluoride polymers are commercially available, for example under the tradename KYNAR from Elf Atochem. KYNAR 301F, a proprietary version of KYNAR 500, is polyvinylidenefluoride and KYNAR 201, a proprietary version of KYNAR 460, is copolyvinylidenefluoride tetrafluoroethylene.

The electropositive polymer, i.e., the polymer that will generally impart a negative charge on the toner which it is contacted with is preferably comprised of a polymer or copolymer of polymethyl methacrylate (PMMA), optionally having carbon black or another conductive material dispersed therein. PMMA by itself is an insulative polymer. To obtain conductive PMMA, a conductive component, for example carbon black, is dispersed in the polymer. The PMMA may be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate; and the like. If the PMMA polymer has carbon black dispersed therein, it is preferably formed in a semisuspension polymerization process, for example as described in U.S. Pat. No. 5,236,629, incorporated by reference herein in its entirety. The PMMA polymer may have a weight average molecular weight of from, for example, 300,000 to 350,000, such as a PMMA commercially available from Soken.

The percentage of each polymer present in the carrier coating mixture can vary depending on the specific components selected, the coating weight and the properties desired. In particular, the ratios of the two polymers may be varied in order to adjust the triboelectric characteristics of the carrier in order to meet the particular $A_T$ requirements of a given printing device. Generally, the coated polymer mixtures used contain from about 3 to about 97 percent of the electronegative polymer, and from about 97 to about 3 percent by weight of the electropositive polymer. Preferably, there are selected mixtures of polymers with from about 3 to 25 percent by weight of the electronegative polymer, and from about 97 to 75 percent by weight of the electropositive polymer. Most preferably, there are selected mixtures of polymers with from about 5 to 20 percent by weight of the electronegative polymer, and from about 95 to 80 percent by weight of the electropositive polymer.

The carrier particles may be prepared by mixing the carrier core with from, for example, between about 0.05 to about 10 percent by weight, most preferably between about 0.3 percent and about 0.5 percent by weight, based on the weight of the coated carrier particles, of the mixture of dry polymers until adherence thereof to the carrier core by mechanical impaction and/or electrostatic attraction. The mixture of carrier core particles and polymers is then heated to a temperature of, for example, between from about 200° F. to about 650° F., preferably 320° F. to 550° F., most preferably 380° F. to 420° F., for a period of time of from, for example, about 10 minutes to about 60 minutes, enabling the polymers to melt and fuse to the carrier core particles. The coated carrier particles are then cooled and thereafter classified to a desired particle size. The coating preferably has a coating weight of from, for example, 0.1 to 3.0% by weight of the carrier, preferably 0.1 to 1.0% by weight.

Various effective suitable means can be used to apply the polymer mixture coatings to the surface of the carrier core particles. Examples of typical means for this purpose include combining the carrier core material and the mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit spreading of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated.

Two component developer compositions of the present invention can be generated by mixing the carrier core particles with a toner composition comprised of resin particles and pigment particles.

It is desirable to maintain a ratio of carrier volume median diameter to toner volume median diameter of approximately 5:1 to 7:1, preferably of about 6:1. The finished coated carrier particles thus should have an average particle size (diameter) of from, for example, 45 to 55 microns, as determined by standard laser diffraction techniques. Most preferably, the carrier particles have a size distribution such that less than 3% of a total number of the carrier particles have a size smaller than 31 microns, 10% or fewer of the total number of carrier particles have a size smaller than 36 microns and 10% or fewer of the total number of carrier particles have a size larger than 72 microns.

The carrier particles can be mixed with the toner particles in various suitable combinations. However, best results are obtained when about 1 part to about 5 parts by weight of toner particles are mixed with from about 10 to about 300 parts by weight of the carrier particles, preferably when 3 to 5 parts by weight of toner particles are mixed with from 90 to 110 parts by weight of the carrier particles. The toner concentration in the developer initially installed in a xerographic development housing is thus preferably between, for example, 3 and 6 percent by weight based on the total developer weight.

Developers incorporating the coated carriers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

In a most preferred embodiment of the present invention, the developers are used to develop latent images using a magnetic brush development system such as discussed above. The developer preferably possesses a triboelectric value (as measured by the known Faraday Cage process) of from, for example, 20 to 25 $\mu$C/g, as well as exhibit triboelectric stability over the life of the developer. Such a development system typically has a machine functional requirement of $A_T$ of about 300 to $500\times10^{-2}$ $\mu$C/g. $A_T$ is a convenient way to quantify the charging ability properties of a developer. The minimum $A_T$ value of an imaging device is that $A_T$ of a developer below which imaging with the developer in the device fails (because, for example, the charge of the toner is so low that the background on the print is visible or too much toner is developed in the image areas causing image quality degradation). $A_T$ is defined as (magnitude of q/m of toner in the developer)×(toner concentration of developer+an offset value). For an imaging device utilizing the toner and developer of the present invention, the offset value is about 8 and the minimum $A_T$ required for good print quality and a clean machine is around $300\times10^{-2}$ $\mu$C/g, for example. Using developers with $A_T$ less than $300\times10^{-2}$ $\mu$C/g, might result in machine dirt, high background or fuzzy images caused by toner pushed or dragged outside the image. These values can be derived by well known techniques in the art. See, for example, R. J. Nash and J. T. Bickmore. 4$^{th}$ *Intl. Cong. On Adv. In Non-Impact Printing Tech.*, R. J. Nash, ed., IS&T,, Springfield, Va., pp. 113–26 (1988); E. J. Gutman and G. C. Hartmann, J. Imaging Sci. & Tech. 36, 4, 335 (1992).

Thus, the developers of the invention preferably have an $A_T$ of from 300 to $500\times10^{-2}$ $\mu$C/g. The $A_T$ must remain stable over the life of the developer so that the images obtained from the developer over its life remain consistent (i.e., have consistently high quality). The life of the developer is typically at least, for example, 200,000 A4 prints.

The developers are most preferably insulative in order to avoid shorting if the photoreceptor surface is scratched and to achieve lower development gamma. The developers are insulating by the choice of carrier design. The carriers have a breakdown voltage greater than 1,700 volts and conductivity of about $1\times10^{-11}$ to about $1\times10^{-10}$ (ohm-cm)$^{-1}$ at 200 volts as measured in a magnetic brush conductivity cell (see, for example, U.S. Pat. No. 5,196,803, incorporated herein by reference).

The conductivity of the developer is primarily driven by the carrier conductivity. To achieve a low conductivity carrier, nearly complete, i.e., greater than 40% coverage of the surface, coatings of polymers are used to cover the carrier core. Additionally, more spherically shaped carrier cores lower the conductivity of the developer.

The most preferred developer compositions utilize the toners of Table 1 and are as summarized in Table 2.

TABLE 2

| Carrier | | | Developer | |
|---|---|---|---|---|
| % Fluoro-polymer | % PMMA | Coating wt. % | Toner | Toner Conc. % |
| 20 | 80 | 0.4 | Y | 3.5 |
| 20 | 80 | 0.4 | C | 3.5 |
| 5 | 95 | 0.4 | M | 3.5 |
| 5 | 95 | 0.4 | K | 3.5 |

The developers of the invention exhibit triboelectric stability, solid area density stability and excellent gloss.

For example, using the most preferred developers of the invention as summarized in Tables 1 and 2 to develop images with a magnetic brush development system, the developers exhibit triboelectric stability and solid area density stability for over 200,000 prints.

Figure 2:
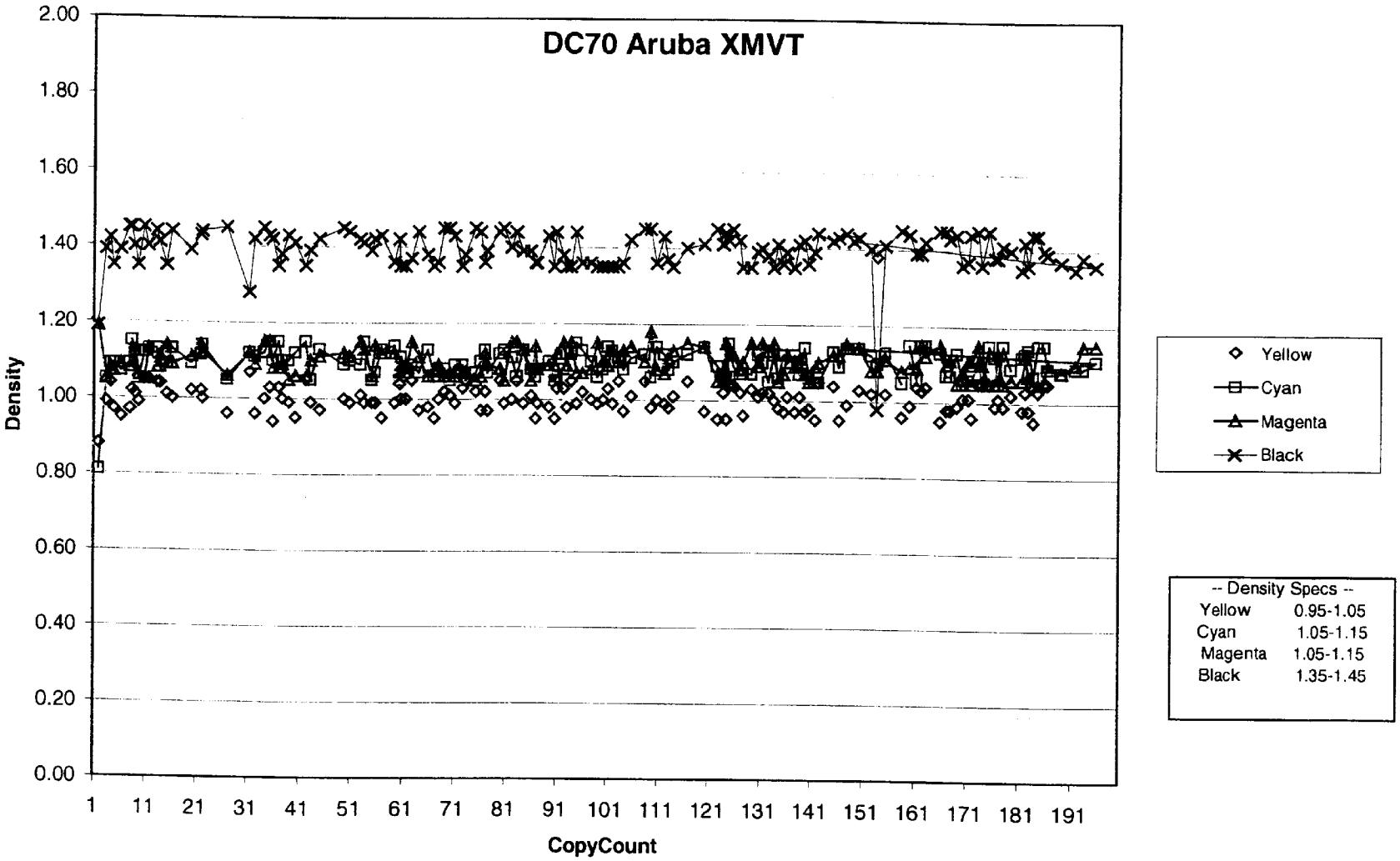

FIGS. 1 and 2 indicate the solid area density (SAD) stability of the developers of the invention. The yellow developer exhibits a SAD of, for example, 0.95 to 1.05, the cyan developer exhibits a SAD of, for example, 1.05 to 1.15, the magenta developer exhibits a SAD of, for example, 1.05 to 1. 15, and the black developer exhibits a SAD of, for example, 1.35 to 1.45.

Figure 3:
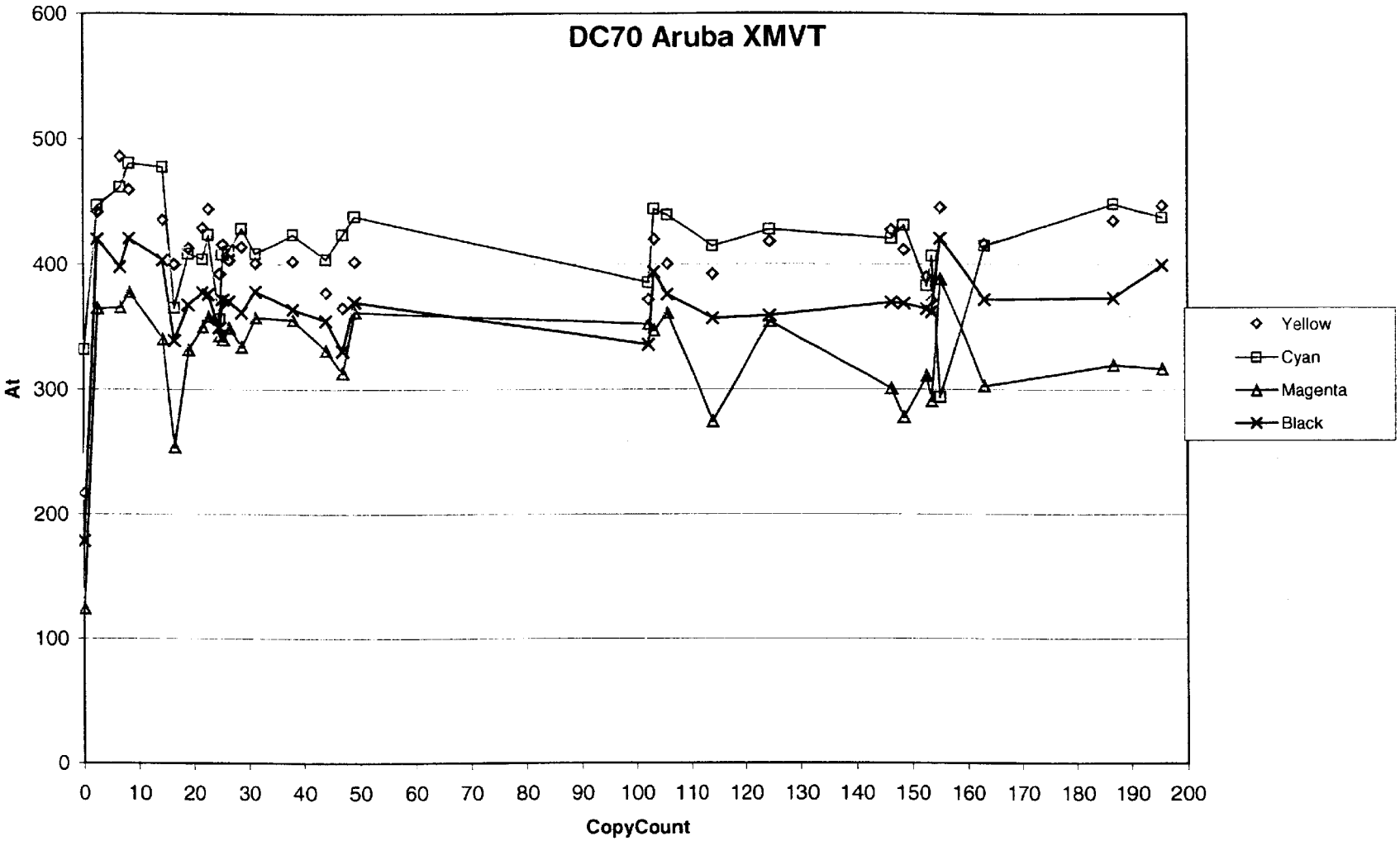
FIGS. 3 and 4 graphically summarize $A_T$ stability over time for two different experiments with developers of the present invention.
Figure 4:
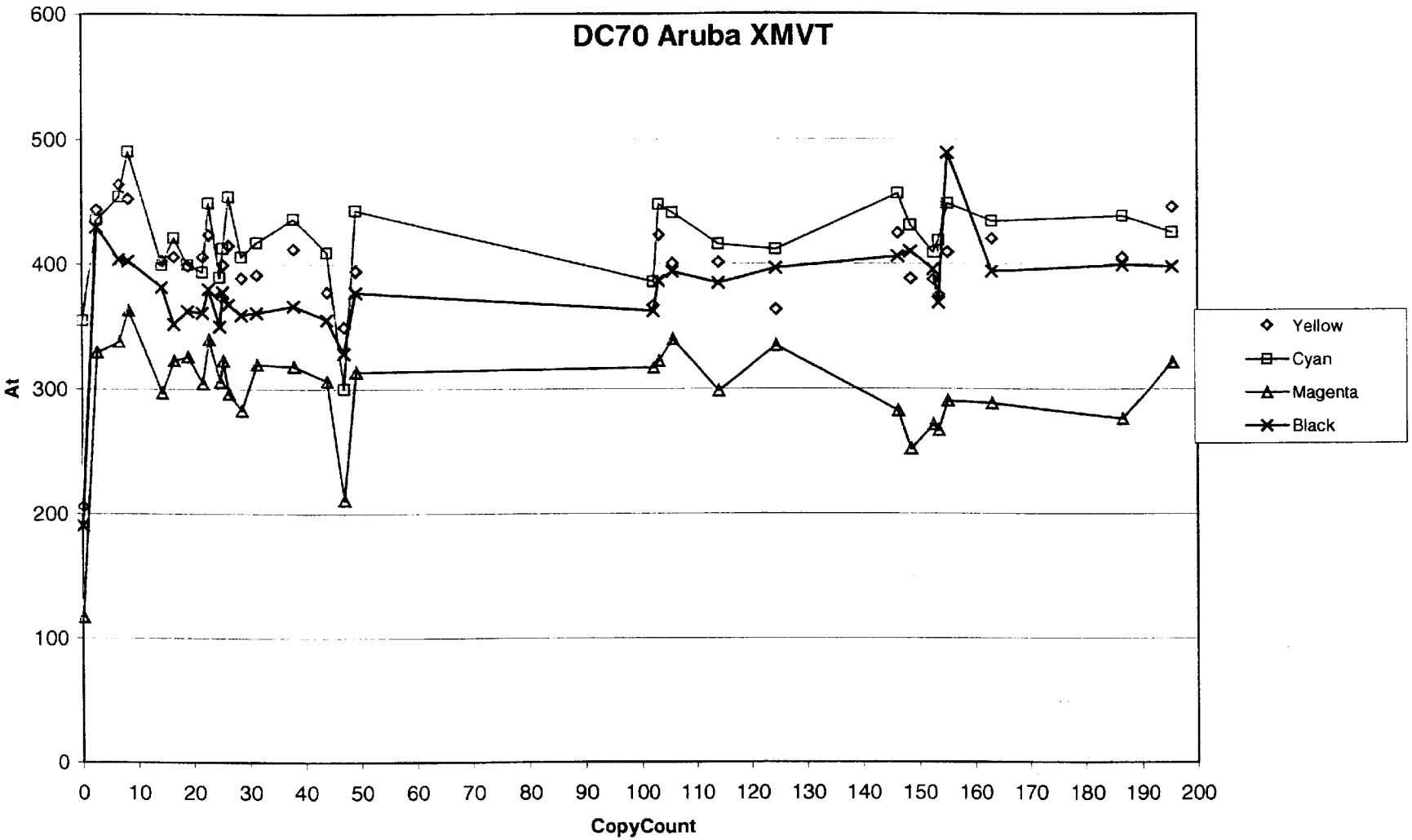

FIGS. 3 and 4 indicate the $A_T$ stability of the developers of the invention. The commercially available XEIKON/

Figure 5:
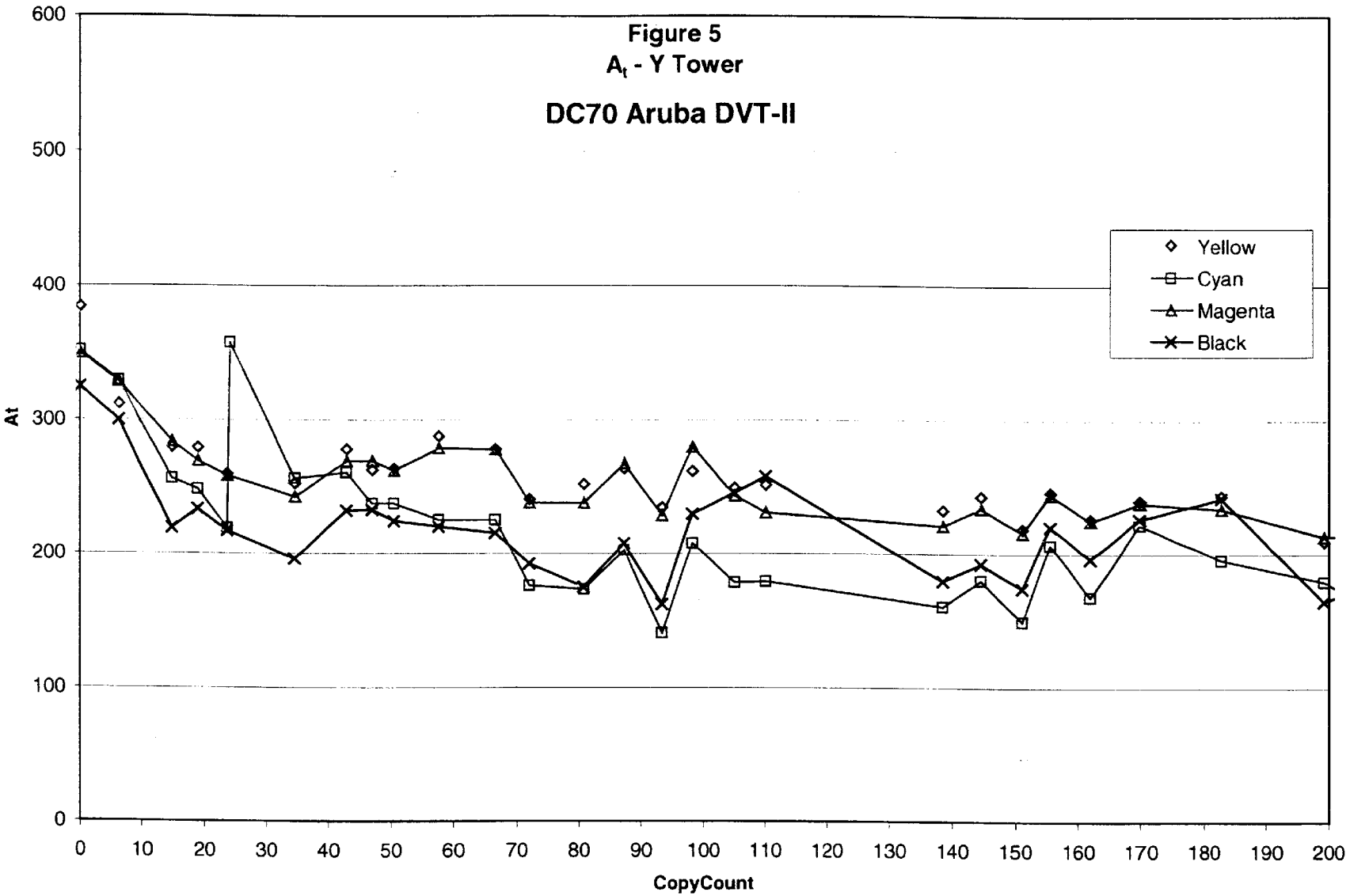
FIG. 5 graphically summarizes $A_t$ stability over time for a known developer manufactured by Xeikon.

AGFA developers, however, show a lack of $A_T$ stability, the $A_T$ steadily failing over time with additional prints as shown in FIG. 5.

Further, wet deposition patches at 0.6 TMA (toner mass per unit area) were prepared from the developers of the invention and XEIKON/AGFA developers. These patches are prepared by forming an aqueous solution of the toner(s), for example using a suitable surfactant, and pulling the liquid through a filter in order to deposit the toners thereon. Red, green and blue layers were made with the following order of colors: magenta over yellow, cyan over yellow, and magenta over cyan. Measurements for white were taken on a virgin wet deposition filter.

The results are summarized in Table 3 and show over a 91K increase in the gamut volume with the developers of the present invention.

TABLE 3

Materials Gamut Volume

| Toner | Gamut Volume | % Pantone colors within dE = 0 |
|---|---|---|
| Invention | 626K | 71 |
| XEIKON/AGFA | 535K | 63 |

Data for machine gamut is also measured, and shown in Table 4.

TABLE 4

Machine Gamut Volume on Uncoated Paper

| Toner | Gamut Volume | % Pantone colors within dE = 0 |
|---|---|---|
| XEROX DC-70 | 298K | 37 |
| XEIKON | 269K | 33 |

What is claimed is:

1. A toner comprising toner particles comprised of at least one binder, at least one colorant, and optionally one or more additives, wherein following triboelectric contact with carrier particles comprising a core of ferrite coated with 0.1 to 3.0% by weight of the carrier particles of a coating comprising a polyvinylidenefluoride polymer or copolymer and a polymethyl methacrylate polymer or copolymer, and in which from 3 parts to 5 parts by weight of the toner is contacted with from 90 parts to 110 parts by weight of the carrier particles, the toner has a charge per particle diameter (Q/D) of from 0.6 to 0.9 fC/$\mu$m and a triboelectric charge of from 20 to 25 $\mu$C/g, wherein the toner melt viscosity at 100° C. ranges from 35,000 to 70,000 poise, and wherein the toner particles have a volume average particle diameter of from 7.8 to 8.3 microns.

2. The toner according to claim 1, wherein the toner melt viscosity at 150° C. ranges from 800 to 2,000 poise.

3. The toner according to claim 1, wherein the at least one binder resin comprises a propoxylated bisphenol A fumarate resin having a gel content of from 9 to 18 weight percent by weight of the binder resin and has a glass transition temperature of from 50° C. to 65° C.

4. The toner according to claim 1, wherein at least one colorant is a pigment having a color selected from the group consisting of cyan, magenta and black, and at least one binder resin comprises a propoxylated bisphenol A fumarate resin having a gel content of from about 9 to about 18 weight percent by weight of the binder resin.

5. The toner according to claim 1, wherein at least one colorant is a yellow pigment and at least one binder resin comprises a propoxylated bisphenol A fumarate resin containing no gel.

6. The toner according to claim 1, wherein the optional one or more additives are present as external additives of one or more of silicon dioxide powder, untreated titanium dioxide powder or zinc stearate powder.

7. The toner according to claim 1, wherein the toner particles have a size distribution such that no more than 8% of a total number of particles have a size less than 5 microns and no more than 1% of a total volume of toner particles have a size greater than 16 microns.

8. The toner according to claim 1, wherein the carrier particles comprise a core comprised of ferrite substantially free of zinc and copper and a coating comprised of a mixture of a polyvinylidenefluoride polymer or copolymer and a polymer or copolymer of polymethyl methacrylate, wherein the coating has a coating weight of from 0.1 to 3.0% by weight of the carrier particles.

9. A developer comprising the toner particles of claim 1 and the carrier particles comprising a core of ferrite coated with 0.1 to 3.0% by weight of the carrier particles of a coating comprising a polyvinylidenefluoride polymer or copolymer and a polymethyl methacrylate polymer or copolymer, wherein the developer comprises from 3 parts to 5 parts by weight of the toner particles and from 90 parts to 110 parts by weight of the carrier particles, and wherein the developer has an $A_T$ of from $300\times10^{-2}$ $\mu$C/g to $500\times10^{-2}$ $\mu$C/g.

10. The developer according to claim 9, wherein a ratio of carrier volume median diameter to toner volume median diameter is from 5:1 to 7:1.

11. The developer according to claim 9, wherein the carrier particles have an average diameter of from 45 to 55 microns and the carrier particles have a size distribution such that less than 3% of a total number of carrier particles have a size less than 31 microns, 10% or less of the total number of carrier particles have a size smaller than 36 microns, and 10% or less of the total number of carrier particles have a size greater than 72 microns.

12. The developer according to claim 9, wherein the carrier particles have a magnetic saturation of from 30 to 110 emu/g, a density of from 2.0 to 3.0 g/cm$^3$, and a breakdown voltage of from 700 to 1000 V.

13. The developer according to claim 12, wherein the carrier particles have a magnetic saturation of from 40 to 100 emu/g, and a density of from 2.2 to 2.5 g/cm$^3$.

14. The developer according to claim 9, wherein the carrier particles comprise a core comprised of ferrite substantially free of zinc and copper and a coating comprised of a mixture of a polyvinylidenefluoride polymer or copolymer and a polymer or copolymer of polymethyl methacrylate, wherein the coating has a coating weight of from 0.1 to 3.0% by weight of the carrier particles.

15. An electrophotographic image forming apparatus comprising a photoreceptor, a magnetic brush development system, and a housing in association with the magnetic brush development system and containing the developer according to claim 9.

16. A toner comprising toner particles comprised of at least one binder resin comprising a propoxylated bisphenol A fumarate resin, at least one colorant comprising pigment having a color selected from the group consisting of cyan, yellow, magenta and black, wherein if the pigment color is cyan, magenta or black, the binder resin has a gel content of from 10 to 15 percent by weight of the binder resin and if the pigment color is yellow, the binder resin contains no gel, and external additives comprising untreated titania in an amount of 0.5 to 5.0 percent by weight of a total weight of the toner, hexamethyldisilazane treated silica in an amount of 0.1 to 3.0 percent by weight of the total weight of the toner, and zinc stearate in an amount of 0.1 to 2.0 percent by weight of the total weight of the toner, and wherein following triboelectric contact with carrier particles comprising a core of ferrite coated with 0.1 to 3.0% by weight of the carrier particles of a coating comprising a polyvinylidenefluoride polymer or copolymer and a polymethyl methacrylate polymer or copolymer, and in which from 3 parts to 5 parts by weight of the toner is contacted with from 90 parts to 110 parts by weight of the carrier particles, the toner has a charge per particle diameter (Q/D) of from 0.6 to 0.9 fC/g $\mu$m and a triboelectric charge of from 20 to 25 $\mu$C/g.

17. The toner according to claim 16, wherein at least one binder resin comprises 70 to 98 percent by weight of a total weight of the toner and wherein at least one colorant comprises 2 to 10 percent by weight of the total weight of the toner.

18. The toner according to claim 16, wherein the carrier particles comprise a core comprised of ferrite substantially free of zinc and copper and a coating comprised of a mixture of a polyvinylidenefluoride polymer or copolymer and a polymer or copolymer of polymethyl methacrylate, wherein the coating has a coating weight of from 0.1 to 3.0% by weight of the carrier particles.

* * * * *